US007412838B2

(12) United States Patent
Hamanaka et al.

(10) Patent No.: US 7,412,838 B2
(45) Date of Patent: Aug. 19, 2008

(54) HEAT PUMP USING $CO_2$ AS REFRIGERANT AND METHOD OF OPERATION THEREOF

(75) Inventors: Kunio Hamanaka, Yokohama (JP); Katsumi Fujima, Tsukuba (JP)

(73) Assignee: Mayekawa Mfg. Co., Ltd. (JP)

( * ) Notice: Subject to any disclaimer, the term of this patent is extended or adjusted under 35 U.S.C. 154(b) by 0 days.

(21) Appl. No.: 11/747,493

(22) Filed: May 11, 2007

(65) Prior Publication Data

US 2007/0261432 A1 Nov. 15, 2007

Related U.S. Application Data

(63) Continuation of application No. PCT/JP2004/017207, filed on Nov. 12, 2004.

(51) Int. Cl.
*F25B 13/00* (2006.01)

(52) U.S. Cl. ..... 62/115; 62/198; 62/324.6

(58) Field of Classification Search ..... 62/115, 62/160, 198–200, 324.1, 324.6
See application file for complete search history.

(56) References Cited

U.S. PATENT DOCUMENTS 4,688,390 A * 8/1987 Sawyer ..... 62/160
5,388,419 A * 2/1995 Kaye ..... 62/160
5,461,876 A * 10/1995 Dressler ..... 62/160
6,082,125 A * 7/2000 Savtchenko ..... 62/238.6
6,216,481 B1 * 4/2001 Kantchev ..... 62/238.7
7,185,505 B2 * 3/2007 Kamimura ..... 62/238.7

FOREIGN PATENT DOCUMENTS

| | | | |
|---|---|---|---|
| JP | 58-87072 | U | 6/1983 |
| JP | 8-247496 | A | 9/1996 |
| JP | 2002-054856 | A | 2/2002 |
| JP | 2002-054857 | A | 2/2002 |
| JP | 2002-098437 | A | 4/2002 |
| JP | 2002-146852 | A | 5/2002 |
| JP | 2004-309093 | A | 11/2004 |

OTHER PUBLICATIONS

Relevant Portion of International Search Report issued in corresponding International Application No. PCT/JP2004/017207, with mailing date Mar. 1, 2005.

* cited by examiner

*Primary Examiner*—William E Tapolcai
(74) *Attorney, Agent, or Firm*—Rossi, Kimms & McDowell LLP

(57) ABSTRACT

A heat pump employing $CO_2$ as refrigerant and utilizing heat source of natural water, e.g. well water, ground water, river water or sea water, effectively is applied to an air conditioning system in order to enhance heating/hot water supplying capacity and refrigeration capacity without requiring a large scale appurtenant facilities.

6 Claims, 2 Drawing Sheets

HEAT PUMP USING $CO_2$ AS REFRIGERANT AND METHOD OF OPERATION THEREOF

CROSS REFERENCE TO RELATED APPLICATIONS

This is a continuation of International Application PCT/JP04/17207 (published as WO 2006/051617) having an international filing date of 12 Nov. 2004, the contents of which is incorporated herein by reference.

The present invention relates to a heat pump using $CO_2$ as a refrigerant and utilizing natural water such as well water, underground water, river water, and sea water as a heat source or cold source and a method of operating the heat pump, specifically a heat pump compact in construction and low in cost capable of being switched from heating/hot-water supplying operation and to heating/hot-water supplying and refrigerating operation without requiring a large-scaled ancillary facility, and a method of operating the heat pump so that heating capacity is increased when the heat pump is used for the purpose of room heating or hot-water supplying operation by utilizing natural water as a heat source and so that refrigerating capacity is increased when the heat pump is used for the purpose of heating/hot-water supplying and refrigerating operation by utilizing natural water as a cold source.

BACKGROUND

A variety of systems applying a heat pump employing $CO_2$ as a refrigerant and utilizing natural water such as well water, underground water, etc. as a heat source or cold source to air-conditioning or hot-water supplying, has been proposed in the past.

For example, in Japanese Laid-Open Patent Application Publication No. 8-247496 (prior art 1) is disclosed a system utilizing a heat pump which performs snow melting, room heating, room cooling, etc. utilizing underground water as a heat source or cold source. In the system, pumped-up underground water is used directly to melt snow, and the water after used to melt snow is utilized as a heat source for the evaporator of a heat pump, then the water after use is returned to a well.

In Japanese Laid-Open Patent Application Publications No. 2002-54856 and (prior art 2) and No. 2002-54857 (prior art 3) are disclosed systems in which a heat pump utilizing underground water is applied for the purpose of air conditioning and hot-water supplying for residential houses. In the system, switching between cooling and heating cycle is performed by a four-way valve.

In Japanese Laid-Open Patent Application Publication No. 2002-146852 (prior art 4) is disclosed a system for performing air conditioning, etc. utilizing underground water as a heat source or cold source.

However, these prior arts have such problems that there are technical problems to be solved when applying to practical use, that a large-scaled facility is required, and that high efficiency is not expected, and they are not put into practical use in the present circumstances.

SUMMARY OF THE INVENTION

The present invention was made in light of the problems of the prior arts, and an object of the invention is to enhance heating/hot-water supplying and refrigerating capacity by applying to an air conditioning system a heat pump using $CO_2$ as a refrigerant and utilizing natural water such as well water, underground water, river water, and sea water as a heat source or cold source.

Another object of the invention is to provide a heat pump and a method of operation thereof that does not require a large-scaled ancillary facility when utilizing natural water as a heat source or cold source.

Further object of the invention is to provide a heat pump and a method of operation thereof that makes possible easy and smooth switching of operation mode from heating/hot-water supplying to heating/hot-water supplying and refrigerating and vice versa.

To attain the objects, the present invention proposes a heat pump employing $CO_2$ as refrigerant including; a $CO_2$ circulation path and, in the $CO_2$ circulation path, a compressor for compressing a refrigerant, a gas cooler for cooling the compressed refrigerant thereby producing hot water, expansion valves for allowing the refrigerant to be expanded, a heat exchanger, and evaporators for allowing the expanded and depressurized refrigerant to be evaporated by receiving heat from cold water, in which a first stopper valve and a first expansion valve are provided in parallel with each other in a downstream part from the compressor in the $CO_2$ circulation path, a heat exchanger for allowing the refrigerant to exchange heat with natural water is provided in a downstream part from the first stopper valve and first expansion valve, a second stopper valve and a second expansion valve are provided in parallel with each other in a downstream part from the heat exchanger, and an evaporator is provided in a downstream part from the second stop valve and second expansion valve.

It is preferable that the exit side of the second stopper valve is connected by a bypass line to a downstream part from said evaporator.

The natural water is well water, river water, underground water, or sea water, etc.

The present invention proposes a method of performing heating/hot-water supplying operation using the heat pump composed as mentioned above, in which the refrigerant is expanded by allowing the refrigerant to flow through the first expansion valve by closing the first stopper valve thereby allowing the refrigerant to be evaporated in the heat exchanger by receiving heat from natural water, then the refrigerant is allowed to flow through the second stopper valve which is opened so that the refrigerant is allowed to flow to the compressor without allowing the evaporator to function.

The present invention further proposes a method of performing heating/hot-water supplying and refrigerating operation using the heat pump composed as mentioned above, in which the refrigerant is allowed to flow to the heat exchanger by opening said first stopper valve in order to allow the refrigerant to perform heat exchange with natural water in the heat exchanger, then the refrigerant is allowed to flow through the second expansion valve by closing said second stopper valve to be expanded and depressurized so that the refrigerant is evaporated in the evaporator by receiving heat from cold water, and the evaporated refrigerant flows to the compressor.

In the heat pump according to the invention, the first stopper valve and first expansion valve are provided in parallel with each other in the downstream side of the compressor, the heat exchanger in which the refrigerant exchanges heat with natural water is provided in the downstream part from the first stopper valve and first expansion valve, the second stopper valve and second expansion valve are provided in parallel with each other in the downstream part from the heat exchanger, and the evaporator in which the refrigerant is evaporated by receiving heat from cold water is provided in the downstream part from the second stopper valve and expansion valve, so operation can be switched from heating/ hot-water supplying to heating/hot-water supplying and refrigerating and vise versa extremely easily, and ancillary equipment required for making the operation mode switching possible is very simple. Ancillary facility required for utilizing natural water as a heat source or cold source is only the heat exchanger.

Manipulation to be done is to close the first stopper valve and to open the second stopper valve when performing heating/hot-water supplying operation by the heat pump of the invention. By closing the first stopper valve, the refrigerant flows through the first expansion valve to be expanded and evaporated in the heat exchanger where the refrigerant receives heat from natural water, heat of natural water is utilized effectively and a large heating/hot-water supplying capacity can be obtained. In this case, cold water supply to the evaporator provided in the downstream side is stopped, and the refrigerant flows passing through the second stopper valve which is opened and through the evaporator to the compressor without experiencing any change in the evaporator.

It is preferable to provide a bypass line connecting the exit side of the second stopper valve to the downstream side of the evaporator so that the refrigerant bypasses the evaporator. By this, the refrigerant flows smoothly to the compressor without passing through the evaporator which is not functioning.

When performing heating/hot-water supplying and refrigerating using the heat pump of the invention, manipulation to be done is to open the first stopper valve and to close the second stopper valve. By opening the first stopper valve, the refrigerant flows through the first stopper valve without being expanded to the heat exchanger where the refrigerant is cooled by natural water, for the refrigerant is higher in temperature than the natural water supplied to the heat exchanger. As the second stopper valve is closed, the cooled refrigerant flows through the second expansion valve to be expanded and evaporated in the evaporator by receiving heat from the cold water supplied to the evaporator. In this case, refrigerating capacity is increased by the amount of heat given from the refrigerant to the cold water supplied to the evaporator.

BRIEF DESCRIPTION OF THE DRAWINGS

The invention will be described in detail with reference to the following figures, wherein.

PREFERRED EMBODIMENTS OF THE INVENTION

Preferred embodiments of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
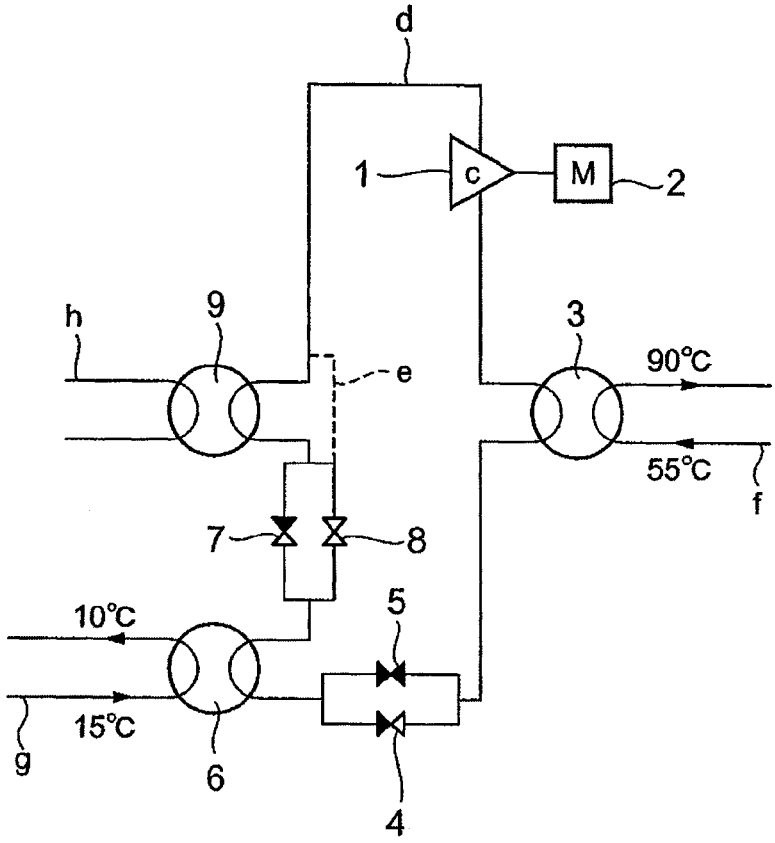
FIG. 1 is a system diagram of the first embodiment when heating or hot-water supplying is performed using the heat pump of the invention.
Figure 2:
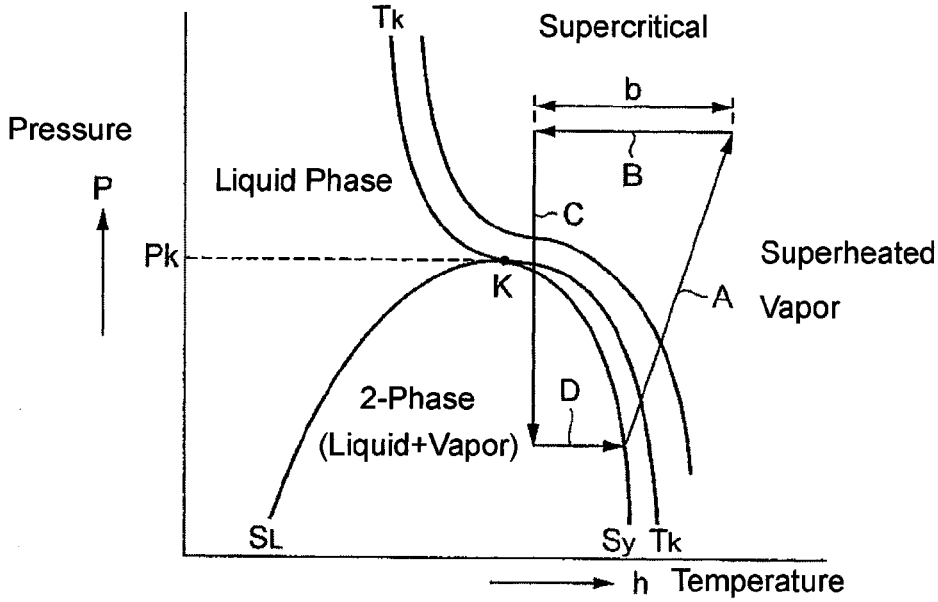
FIG. 2 is a pressure-enthalpy diagram of the first embodiment.

Referring to FIGS. 1 and 2 for explaining the first embodiment, reference symbol d indicates a circulation path of $CO_2$ refrigerant, reference numeral 1 is a compressor for compressing the $CO_2$ refrigerant, 2 is a motor for driving the compressor 1, and 3 is a gas cooler for cooling the compressed $CO_2$ refrigerant by the medium of water fed via a feedwater line f. Feedwater of 55° C. is supplied to the gas cooler 3 and heated to 90° C. by the $CO_2$ refrigerant for example as shown in FIG. 1.

Reference numerals 4 and 5 are a first expansion valve and a first stopper valve respectively provided in the circulation line d in parallel with each other, 6 is a heat exchanger for allowing heat exchange between the $CO_2$ refrigerant and well water supplied via a well water line g. Reference numerals 7 and 8 are a second expansion valve and a second stopper valve respectively provided in the circulation path d in the downstream part from the heat exchanger 6 in parallel with each other, 9 is an evaporator for allowing the $CO_2$ refrigerant to be evaporated by receiving heat from cold water fed via a cold water line h. It is suitable as an another embodiment to provide a bypass line e connecting the exit side of the second stopper valve 8 to the circulation path d in the downstream side of the evaporator 9.

In the heat pump of this composition, when performing heating/hot-water supply operation, first the first stopper valve 5 is closed and the second stopper valve 8 is opened. In this state, $CO_2$ refrigerant is compressed by the compressor 1 to be raised in pressure and temperature (compression process A in FIG. 2), then the compressed refrigerant is cooled in the gas cooler 3 by the feedwater fed via the feedwater line f (cooling process B in FIG. 2). On the other hand, the feedwater is heated from 55° C. to 90° C. to be used for room heating or hot-water supplying as shown in FIG. 1, for example.

The compressed $CO_2$ refrigerant cooled in the gas cooler 3 flows through the first expansion valve 4 to be expanded (expansion process C in FIG. 2) and depressurized, because the first stopper valve 5 is closed, and the depressurized $CO_2$ refrigerant evaporates in the heat exchanger 6 receiving heat from the well water supplied via the well water line g (evaporation process D in FIG. 2). On the other hand, the well water supplied via the well water line g is cooled from 15° C. to 10° C. as shown in FIG. 1, for example.

Then the evaporated $CO_2$ refrigerant flows through the second stopper valve 8 which is opened and the evaporator 9 to the compressor 1. In this embodiment, water supply to the evaporator 9 via the cold water line h is not done, as the heat pump is operated for the purpose of heating/hot-water supplying.

In the p-h diagram of FIG. 2, K is the critical point of $CO_2$ (critical temperature of 31.1° C. and critical pressure of 75.28 $Kg/cm^2$), SL is the saturated liquid line, Sy is the dry saturated vapor line, Tk is an isothermal line, and Pk is the critical pressure. Length b represents heating/hot-water supplying capacity.

According to the first embodiment, high heating/hot-water supply capacity b can be obtained by utilizing heat of the well water supplied via the well water line g. Further, as the first and second stopper valves 5 and 8 are arranged in parallel with the first and second expansion valves 4 and 7 respectively, heating/hot-water supplying operation can be performed only by closing the first stopper valve 5 and opening the second stopper valve 8. Further, only the heat exchanger 6 which performs heat exchange between well water and $CO_2$ refrigerant is required as an ancillary facility for utilizing heat of well water, so the system can be composed very compactly.

By providing the bypass line e connecting the exit side of the second stopper valve 8 to the circulation path d in the downstream part from the evaporator 9 as an another embodiment, $CO_2$ refrigerant can be introduced to the compressor smoothly without passing through the evaporator 9.

Figure 3:
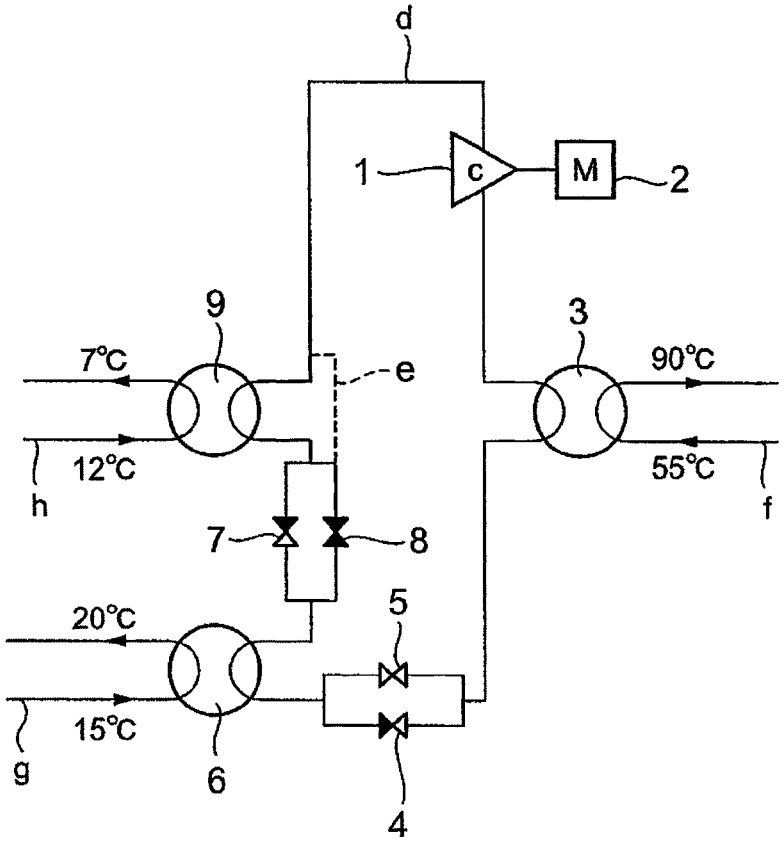
FIG. 3 is a system diagram of the second embodiment when heating or hot-water supplying and cooling are performed using the heat pump of the invention.

Next, when performing heating/hot-water supplying and cooling operations will be explained with reference to FIGS. 3 and 4 that depict respectively the system diagram and p-h diagram of the second embodiment of the invention.

In the drawings, construction of the heat pump is the same as that of the first embodiment. When performing heating/hot-water supplying and cooling operations in the second embodiment, first of all, the first stopper valve 5 is opened and the second stopper valve 8 is closed.

Figure 4:
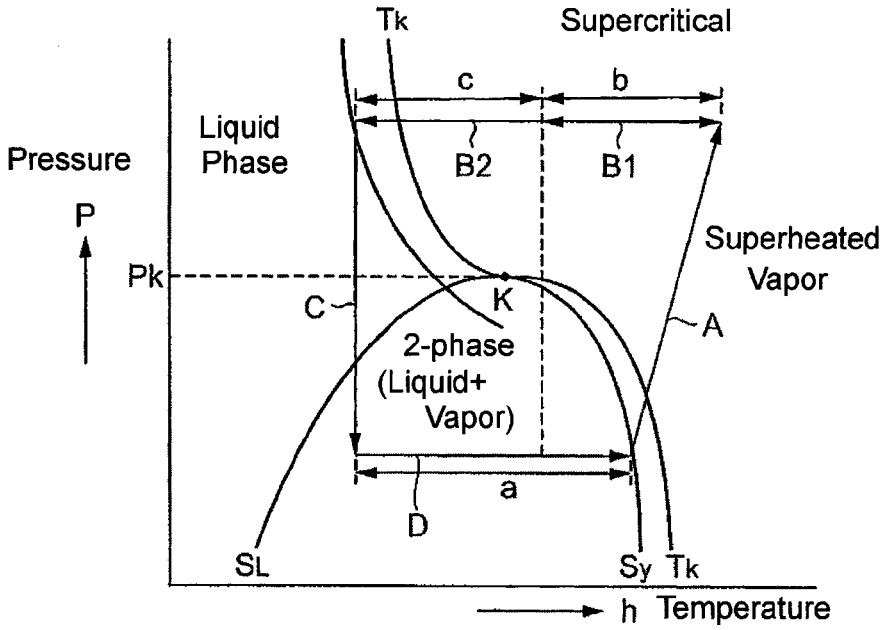
FIG. 4 is a pressure-enthalpy diagram of the second embodiment.

In this state, $CO_2$ refrigerant is compressed by the compressor 1 to be raised in pressure and temperature (compression process A in FIG. 4), then the compressed refrigerant is cooled in the gas cooler 3 by the feedwater fed via the feedwater line f (cooling process B1 in FIG. 4). On the other hand, the feedwater is heated from 55° C. to 90° C. to be used for room heating or hot-water supplying, for example.

The compressed $CO_2$ refrigerant cooled in the gas cooler 3 flows through the first stopper valve 5 to the heat exchanger 6. The $CO_2$ refrigerant entering the heat exchanger 6 is higher in temperature than well water supplied via the well water line g and cooled by the well water (cooling process B2 in FIG. 4). On the other hand, the well water supplied via the well water line g is heated from 15° C. to 20° C. as shown in FIG. 3, for example.

Since the second stopper valve 8 provided in the downstream side of the heat exchanger 6 is closed, the $CO_2$ refrigerant cooled in the heat exchanger 6 flows through the second expansion valve 7 to be expanded and depressurized (expansion process C in FIG. 4), then evaporates in the evaporator 9 receiving heat from the cold water supplied via the cold water line h (evaporation process D in FIG. 4).

In FIG. 4, length a represents refrigerating capacity, length b represents heating/hot-water supplying capacity, and length c represents performance of cooling the $CO_2$ refrigerant by the well water in the heat exchanger 6, in the operation according to the second embodiment.

According to the second embodiment, refrigerating capacity is increased by the amount of cooling performance of cooling the $CO_2$ refrigerant by the well water in the heat exchanger 6. Further, operation mode can be changed simply only by switching operation of the first and second stopper valves 5 and 8. Furthermore, system composition required to allow operation mode changing is to arrange each of the expansion valves and stopper valves in parallel with each other, so the system can be composed simple in construction and low in cost.

INDUSTRIAL APPLICABILITY

According to the invention, by using the heat pump composed such that the first stopper valve and first expansion valve are provided in parallel with each other in the downstream part from the compressor, the heat exchanger in which heat exchange is performed between the refrigerant and natural water is provided in the downstream side of the first stopper valve and first expansion valve, the second stopper valve and second expansion valve are provided in parallel with each other in the downstream side of the heat exchanger, and the evaporator in which the refrigerant receives heat from cold water and evaporates is provided in the downstream side of the second stopper valve and second expansion valve, a system of heating/hot-water supplying and refrigerating utilizing natural water as a heat source or cold source can be composed without requiring a large-scaled facility for utilizing natural water. Further, composition required for operation mode switching from heating/hot-water supplying to heating/hot-water supplying and refrigerating and vice versa is that two sets of a stopper valve and an expansion valve are provided with the stopper valve and expansion valve arranged in parallel with each other, so the system can be composed simple in construction and low in cost.

When applying the heat pump composed as mentioned above to an air conditioning system and operating to perform heating/hot-water supplying, the first stopper valve is closed and the refrigerant cooled in the gas cooler is allowed to flow through the first expansion valve to be expanded, and then the depressurized refrigerant is evaporated in the heat exchanger by receiving heat from natural water. By utilizing heat of natural water like this, a large heating/hot-water supplying capacity can be obtained.

When performing heating/hot-water supplying and refrigerating, the first stopper valve is opened to allow the refrigerant cooled in the gas cooler to flow through the first stopper valve to the heat exchanger where the refrigerant is further cooled and allowed to flow through the second expansion valve to the evaporator by closing the second stopper valve, then the expanded and depressurized refrigerant is evaporated in the evaporator by receiving heat from cold water and the evaporated refrigerant flows to the compressor. By utilizing cold heat of natural water, a large heating/hot-water supplying capacity is obtained and at the same time refrigerating capacity is largely increased.

What is claimed is:

1. A heat pump employing $CO_2$ as a refrigerant comprising:

a $CO_2$ circulation path, a compressor for compressing the refrigerant, a gas cooler for cooling the compressed refrigerant to produce hot water, expansion means for allowing the refrigerant to be depressurized and expanded, a heat exchanger for allowing the refrigerant to exchange heat with natural water, an evaporator for allowing the expanded and depressurized refrigerant to be evaporated by receiving heat from cold water, and a first stopper valve and a second stopper valve, wherein the expansion means comprises a first expansion valve and a second expansion valve, wherein the first stopper valve and the first expansion valve are provided in parallel with each other downstream from the compressor in the $CO_2$ circulation path, wherein the heat exchanger is provided downstream from the first stopper valve and the first expansion-valve, wherein the second stopper valve and the second expansion valve are provided in parallel with each other downstream from the heat exchanger, wherein the evaporator is provided downstream from the second stopper valve and the second expansion valve, and wherein opening and closing of the first stopper valve and the second stopper valve allow switching between a heating/hot-water supplying mode, where heated water is supplied from water heated in the heat exchanger by heat exchange with the refrigerant and a cooling/cool-water supplying mode, where cooled water is supplied from water cooled in the heat exchanger by heat exchange with the refrigerant.

2. A heat pump employing $CO_2$ as a refrigerant comprising:

a $CO_2$ circulating path, a compressor for compressing the refrigerant, a gas cooler for cooling the compressed refrigerant to produce hot water, expansion means for allowing the refrigerant to be depressurized and expanded, a heat exchanger for allowing the refrigerant to exchange heat with natural water at a temperature lower than a critical temperature of $CO_2$, an evaporator for allowing the expanded and depressurized refrigerant to be evaporated by receiving heat from cold water, a first stopper valve and a second stopper valve, and a bypass path, wherein the expansion means comprises a first expansion valve and a second expansion valve, wherein the first stopper valve and the first expansion valve are provided in parallel with each other downstream from the compressor, wherein the heat exchanger is provided downstream from the first stopper valve and the first expansion valve, wherein the second stopper valve and the second expansion valve are provided in parallel with each other downstream from the heat exchanger, wherein the evaporator is provided downstream from the second stopper valve and the second expansion valve, and wherein the bypass path connects from an exit side of the second stopper valve to the $CO_2$ circulation path downstream from the evaporator.

3. A heat pump employing $CO_2$ as a refrigerant according to claim 1, wherein said natural water is well water, river water, underground water, or sea water at a temperature lower than the critical temperature of $CO_2$.

4. A method of heating and cooling using a heat pump employing $CO_2$ as a refrigerant comprising a $CO_2$ circulating path, a compressor for compressing the refrigerant, a gas cooler for cooling the compressed refrigerant to produce hot water, expansion means for allowing the refrigerant to be depressurized and expanded, a heat exchanger for allowing the refrigerant to exchange heat with natural water at a temperature lower than a critical temperature of $CO_2$, an evaporator for allowing the expanded and depressurized refrigerant to be evaporated by receiving heat from cold water, a first stopper valve and a second stopper valve, and a bypass path, wherein the expansion means comprises a first expansion valve and a second expansion valve, wherein the first stopper valve and the first expansion valve are provided in parallel with each other downstream from the compressor, wherein the heat exchanger is provided downstream from the first stopper valve and the first expansion valve, wherein the second stopper valve and the second expansion valve are provided in parallel with each other downstream from the heat exchanger, wherein the evaporator is provided downstream from the second stopper valve and the second expansion valve, and wherein the bypass path connects from an exit side of the second stopper valve to the $CO_2$ circulation path downstream from the evaporator, the method comprising the steps of:

heating water in the gas cooler by heat exchange with the refrigerant; and cooling water in the heat exchanger, wherein the cooling step comprises:

flowing the refrigerant through the first expansion valve by closing the first stopper valve to depressurize and expand the refrigerant;

flowing the depressurized and expanded refrigerant through the heat exchanger to evaporate the refrigerant with heat from natural water at a temperature lower than a critical temperature of $CO_2$; and flowing the refrigerant through the second stopper valve, which is opened, and through the bypass path to the compressor to bypass the evaporator.

5. A method of heating and cooling using a heat pump employing $CO_2$ as a refrigerant comprising a $CO_2$ circulation path, a compressor for compressing the refrigerant, a gas cooler for cooling the compressed refrigerant to produce hot water, expansion means for allowing the refrigerant to be depressurized and expanded, a heat exchanger for allowing the refrigerant to exchange heat with natural water, an evaporator for allowing the expanded and depressurized refrigerant to be evaporated by receiving heat from cold water, and a first stopper valve and a second stopper valve, wherein the expansion means comprises a first expansion valve and a second expansion valve, wherein the first stopper valve and the first expansion valve are provided in parallel with each other downstream from the compressor in the $CO_2$ circulation path, wherein the heat exchanger is provided downstream from the first stopper valve and the first expansion valve, wherein the second stopper valve and the second expansion valve are provided in parallel with each other downstream from the heat exchanger, wherein the evaporator is provided downstream from the second stopper valve and the second expansion valve, and wherein opening and closing of the first stopper valve and the second stopper valve allow switching between a heating/hot-water supplying mode, where hot water is supplied from water heated in the heat exchanger by heat exchange with the refrigerant, and a cooling/cool-water supplying mode, where cooled water is supplied from water cooled in the heat exchanger by heat exchange with the refrigerant, the method comprising the steps of:

heating water in the gas cooler by heat exchange with the refrigerant; and cooling water in the evaporator, wherein the cooling step comprises the steps of:

flowing the refrigerant through the heat exchanger through the first stopper valve by opening the first stopper valve to cool the refrigerant with heat exchange with natural water at a temperature lower than a critical temperature of $CO_2$;

flowing the refrigerant through the second expansion valve by closing the second stopper valve to expand and evaporate the refrigerant in the evaporator with heat from cold water; and flowing the evaporated refrigerant to the compressor.

6. A method of heating and cooling using a heat pump employing $CO_2$ as a refrigerant comprising a $CO_2$ circulating path, a compressor for compressing the refrigerant, a gas cooler for cooling the compressed refrigerant to produce hot water, expansion means for allowing the refrigerant to be depressurized and expanded, a heat exchanger for allowing the refrigerant to exchange heat with natural water at a temperature lower than a critical temperature of $CO_2$, an evaporator for allowing the expanded and depressurized refrigerant to be evaporated by receiving heat from cold water, a first stopper valve and a second stopper valve, and a bypass path, wherein the expansion means comprises a first expansion valve and a second expansion valve, wherein the first stopper valve and the first expansion valve are provided in parallel with each other downstream from the compressor, wherein the heat exchanger is provided downstream from the first stopper valve and the first expansion valve, wherein the second stopper valve and the second expansion valve are provided in parallel with each other downstream from the heat exchanger, wherein the evaporator is provided downstream from the second stopper valve and the second expansion valve, and wherein the bypass path connects from an exit side of the second stopper valve to the $CO_2$ circulation path downstream from the evaporator, the method comprising the steps of:

heating water in the gas cooler by heat exchange with the refrigerant; and cooling water in the evaporator, wherein the cooling step comprises:

flowing the refrigerant to the heat exchanger through the first stopper valve by opening the first stopper valve to cool the refrigerant by heat exchange with natural water at a temperature lower than a critical temperature of $CO_2$ in the heat exchanger;

flowing the refrigerant through the second expansion valve by closing the second stopper valve to expand and evaporate the refrigerant in the evaporator with heat from cold water; and flowing the evaporated refrigerant to the compressor.

* * * * *